US007070678B2

(12) United States Patent
Allen et al.

(10) Patent No.: US 7,070,678 B2
(45) Date of Patent: Jul. 4, 2006

(54) PAPER WEBS HAVING A WATERMARK PATTERN

(75) Inventors: Peter J. Allen, Neenah, WI (US); Joseph G. Capizzi, Neenah, WI (US); Mark Alan Burazin, Oshkosh, WI (US); Chuan-Ling Tsai, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/999,164

(22) Filed: Nov. 30, 2001

(65) Prior Publication Data

US 2003/0102098 A1 Jun. 5, 2003

(51) Int. Cl.
*D21H 11/00* (2006.01)
*D21H 13/00* (2006.01)

(52) U.S. Cl. ..... 162/109; 162/110; 162/111; 162/112; 162/116; 162/290; 162/301; 428/131; 428/212; 428/218; 428/137

(58) Field of Classification Search ..... 162/109, 162/110, 111, 112, 116, 290, 301; 428/131, 428/212, 218, 34.5, 137
See application file for complete search history.

(56) References Cited

U.S. PATENT DOCUMENTS

| | | | | |
|---|---|---|---|---|
| 4,056,433 | A * | 11/1977 | Koponen et al. | 162/290 |
| 4,637,859 | A * | 1/1987 | Trokhan | 162/109 |
| 5,245,025 | A | 9/1993 | Trokhan et al. | |
| 5,503,715 | A | 4/1996 | Trokhan et al. | |
| 5,654,076 | A * | 8/1997 | Trokhan et al. | 428/131 |
| 5,660,904 | A | 8/1997 | Andersen et al. | |
| 5,705,239 | A | 1/1998 | Andersen et al. | |
| 5,707,474 | A | 1/1998 | Andersen et al. | |
| 5,709,913 | A | 1/1998 | Andersen et al. | |
| 5,804,281 | A | 9/1998 | Phan et al. | |
| 5,830,548 | A | 11/1998 | Andersen et al. | |
| 6,090,195 | A | 7/2000 | Andersen et al. | |
| 6,136,146 | A * | 10/2000 | Phan et al. | 162/109 |
| 6,180,037 | B1 | 1/2001 | Andersen et al. | |
| 6,203,666 | B1 | 3/2001 | Hanaya | |
| 6,231,723 | B1 | 5/2001 | Kanitz et al. | |

FOREIGN PATENT DOCUMENTS

| | | |
|---|---|---|
| EP | 0072188 | 2/1983 |
| GB | 1157407 | 7/1969 |
| WO | WO 0073580 | 12/0000 |

OTHER PUBLICATIONS

Von Paleske (WO 00 73580) Dec. 7, 2000, Translation from German.*
"Suction Roll Covers" (Research Disclosure), Kenneth Mason Publications, Hampshire, GB, No. 382, Feb. 1, 1996, p. 151.
PCT Search Report, Nov. 7, 2002.

* cited by examiner

*Primary Examiner*—Mark Halpern
(74) *Attorney, Agent, or Firm*—Dority & Manning, P.A.

(57) ABSTRACT

A process for producing paper webs having a pattern formed into the web is disclosed. The pattern is formed during formation of the web and is made by varying the basis weight of the web. The paper web is produced by depositing an aqueous suspension of fibers between two forming surfaces. One or both of the forming surfaces include lower permeability areas that create lower basis weight areas in the web. The lower permeability areas are contained in the forming surface according to a particular pattern. For instance, the lower permeability areas can be formed into a drainage roll sleeve contained on a drainage roll which contacts a forming surface. The drainage roll can be a forming roll or a breast roll.

21 Claims, 7 Drawing Sheets

PAPER WEBS HAVING A WATERMARK PATTERN

BACKGROUND OF THE INVENTION

Paper products, particularly paper webs, are useful for a wide variety of applications. Such paper products include various consumer products such as facial tissues, bath tissues, paper towels, industrial wipers, and other similar personal care articles.

Typically, In making various paper products, an aqueous suspension containing pulp fibers is first formed. The aqueous suspension can then be spread out over a forming surface in order to form a paper web. The forming surface generally includes one or more endless conveyors which are formed from a porous fabric. The porous fabric conveyors can be made from metal, plastic or any other suitable material.

In one embodiment, especially when forming low basis weight paper products such as tissues, the non-woven web is formed in between a pair of forming fabrics. More specifically, in these systems, an aqueous suspension of fibers is injected onto one or in between a pair of moving fabrics as the fabrics are placed adjacent to one another by a breast roll. The fabrics can then be wrapped around another roll, which is generally referred to as a forming roll. The forming roll, and sometimes the breast roll, assist in draining liquids from the web. These types of systems are typically referred to as 'roll formers'. Examples of roll formers include twin-wire systems and crescent-former systems.

In the past, many attempts have been made to enhance and increase certain physical properties of paper products and other similar articles. Unfortunately, however, when steps are usually taken to increase one property of a paper web, other characteristics of the web may be adversely affected. As such, a need exists for a process that can control properties of the web, such as tensile, tear, toughness, stretch, and burst, without adversely effecting the overall quality of the web.

In many applications, in addition to the importance of optimizing physical properties, it is important for the paper product to be visually appealing. Consequently, many attempts have been made to design a paper product having aesthetic appeal by printing, embossing or otherwise forming various patterns on the product. For instance, U.S. Pat. No. 5,654,076 to Trokhan et al, which is incorporated herein by reference to the extent it is not contradictory herewith, discloses a single lamina cellulosic fibrous structure having at least two regions disposed in a nonrandom, repeating pattern. The two regions are distinguished from one another by basis weight. PCT Application having Publication Number WO 96/35018, which is also incorporated herein by reference to the extent it is not contradictory herewith, discloses tissue sheets having a distinct decorative pattern formed by varying the basis weight of the sheet.

The present invention is directed to a process for forming distinctive paper products that not only can have enhanced physical properties, but can also be designed to have an enhanced appearance.

SUMMARY OF THE INVENTION

In one embodiment, the present invention is directed to a process for producing paper webs having areas of higher basis weight and lower basis weight. The process includes forming an aqueous suspension of fibers. The fibers contained within the aqueous suspension can be pulp fibers alone or pulp fibers mixed with other fibers. A headbox can receive the aqueous suspension of fibers, which can then be directed between a first and second forming surface. The first and second forming surfaces can be configured to allow fluids to drain from the aqueous suspension. At least one of the forming surfaces can have a predetermined pattern of lower permeability sections.

In one embodiment, the first forming surface can have a predetermined pattern of lower permeability sections and can be positioned on a drainage roll. The drainage roll can be, for example, a forming roll or a breast roll that can define some form of drainage channels. The predetermined pattern of lower permeability sections can be created by a drainage roll sleeve positioned over the drainage roll. The drainage roll sleeve can be located between the drainage roll and the forming surface. In this embodiment, fluids drained from the aqueous suspension flow through the drainage roll sleeve. Fluids need not flow through the entire drainage roll sleeve, however. For example, in one embodiment of the invention, fluid flow can be completely blocked off at the lower permeability areas of the sleeve.

According to the present invention, a paper web is formed between the forming surfaces. The paper web that is formed includes first areas having a first basis weight and second areas having a second basis weight. The first basis weight is greater than the second basis weight. The second, lower basis weight areas of the web are formed on the first forming surface where the lower permeability sections are located. The first and second areas define a pattern of fiber distribution gradients in the paper web.

Depending upon the system configuration, the amount of variation in basis weight between the lower basis weight areas and the higher basis weight areas can be controlled. For example, during formation of the web, fluids are drained from the aqueous suspension of fibers not only through a first forming surface covering the drainage roll but also through a second forming surface opposite the drainage roll. The amount of variation in basis weight can then be controlled by controlling the amount of drainage that occurs through each surface. For example, drainage through the first forming fabric can comprise from about 20% to about 90% of the total fluid drainage of the system. More particularly, fluid drainage through the first forming fabric can comprise from about 40% to about 60% of the total fluid drainage of the system. In one embodiment, the forming roll can be a vacuum roll, and drainage through the drainage roll can be controlled by increasing or decreasing a suction force placed in the drainage roll. Adjusting the permeability of the first forming surface in relation to the second forming surface can also control drainage characteristics.

By controlling drainage between the first forming surface and the second forming surface, a dramatic difference in results can be obtained. For example, in one embodiment, when drainage occurs through both forming surfaces, the net result is the formation of a fiber lattice which includes a fiber distribution that changes as a function of the thickness of the web. For instance, the side of the paper web in communication with the first forming surface will form a pattern of fiber distribution gradients that include higher basis weight areas and lower basis weight areas. The opposite side of the paper web, however, contacting the second forming surface, can include essentially homogenous drainage, and create a homogenous fiber distribution. Thus, the resulting paper web will include lower and higher basis weight areas on one side of the web and a uniform basis weight on the other side of the web where the fiber distribution is homogenous.

The properties of the higher and lower basis weight areas are governed by the shape and spacing of the lower permeability sections created on the drainage roll sleeve. The substantially homogenous fiber distribution on the second side of the sheet is created by drainage through the second forming surface that does not contain any lower permeability sections. Such a sheet will have properties similar to a laminate and can be tailored to have characteristics superior to a homogenous sheet of the same weight.

Alternatively, the second forming surface can also contain a pattern of higher and lower permeability areas. For example, the second forming surface can contact a second drainage roll which is surrounded by a drainage roll sleeve having a similar configuration i.e. the second drainage roll sleeve located between the second drainage roll and the second forming surface. In this configuration, the first drainage roll can be a forming roll and the second drainage roll can be a breast roll.

The second drainage roll sleeve can include a second pattern of higher and lower permeability areas. In this embodiment, a paper web can be formed in which both sides of the paper web can include patterns of lower and higher basis weight areas. The first side of the web containing first and second basis weight areas in one pattern, and the second side of the web containing third and fourth basis weight areas in another pattern. The patterns on either side of the web could then overlap each other.

The present invention is also directed to paper products made according to the above process. The paper products include a paper web containing pulp fibers. The paper web includes a first side and a second side. The first side of the paper web includes first areas having a first basis weight and second areas having a second basis weight. The second areas are located on the first side of the web according to a predetermined pattern. The first basis weight is greater than the second basis weight. The difference in basis weight between the areas can be large enough to render the pattern visible.

The second basis weight areas can be located on the web in any of a variety of patterns. For example, the second areas can comprise individually discrete shapes surrounded by the first areas. Alternatively, the second areas can be connected to each other. In general, the individually discrete shapes can have a greatest dimension of at least one millimeter.

The first basis weight areas can comprise at least about 25% of the area of the paper web. In one embodiment, the first areas can comprise rows surrounding the second areas. These rows can be in the machine direction of the web, the cross-machine direction, or a diagonal direction.

For most applications, the basis weight of the first areas are at least 1.1 times greater than the basis weight of the second areas, and particularly are from about 1.1 times greater to about 3.3 times greater than the basis weight of the second areas.

Paper products made according to the present invention can be paper towels, and industrial wipers. The present invention is also particularly well suited to producing tissue products, such as facial tissues and bath tissues. The paper webs can have a basis weight of from about 6 lbs per ream to about 70 lbs per ream. For instance, tissue products typically have a basis weight less than about 20 lbs per ream, while paper towels typically have a basis weight of from about 30 lbs per ream to about 70 lbs per ream. The paper web can be a single layer web that can consist of a mix of fibers or alternatively consist essentially of pulp fibers.

In another embodiment, the invention is directed to a drainage roll used in producing a web containing higher and lower basis weight areas. The drainage roll can be any cylinder-shaped roll that defines some sort of passages to allow fluid drainage. The passages can be, for example, holes or channels in the cylinder.

The drainage roll can be wrapped by a drainage roll sleeve having higher and lower permeability areas. The drainage roll sleeve can have higher permeability areas that make up at least about 25% of the drainage roll sleeve. The drainage roll sleeve can be formed of polymeric fibers or a metal.

The higher and lower permeability areas can be formed in any one of a number of fashions. For example, in one embodiment, the pattern of higher and lower permeability areas can be created by a coating. For example, the lower permeability areas of the drainage roll sleeve can be created by a coating of a glue, a paint, an epoxy, a caulk, a rubber, or a sealant. Alternatively, the higher and lower permeability areas can be formed on the drainage roll sleeve by use of a photo-sensitive resin.

Other methods of forming the areas of higher and lower permeability on the drainage roll sleeve can include woven patterns formed into the drainage roll sleeve material or different materials of different permeabilities being attached to each other in order to form the complete drainage roll sleeve.

The drainage roll sleeve of the present invention can be a multi-layer drainage roll sleeve. In this case, the areas of higher and lower permeability can be formed on one of the layers. This can be the layer of the drainage roll which contacts the forming surface.

In another embodiment, the present invention is directed to a system for producing paper webs having areas of higher basis weight and lower basis weight.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
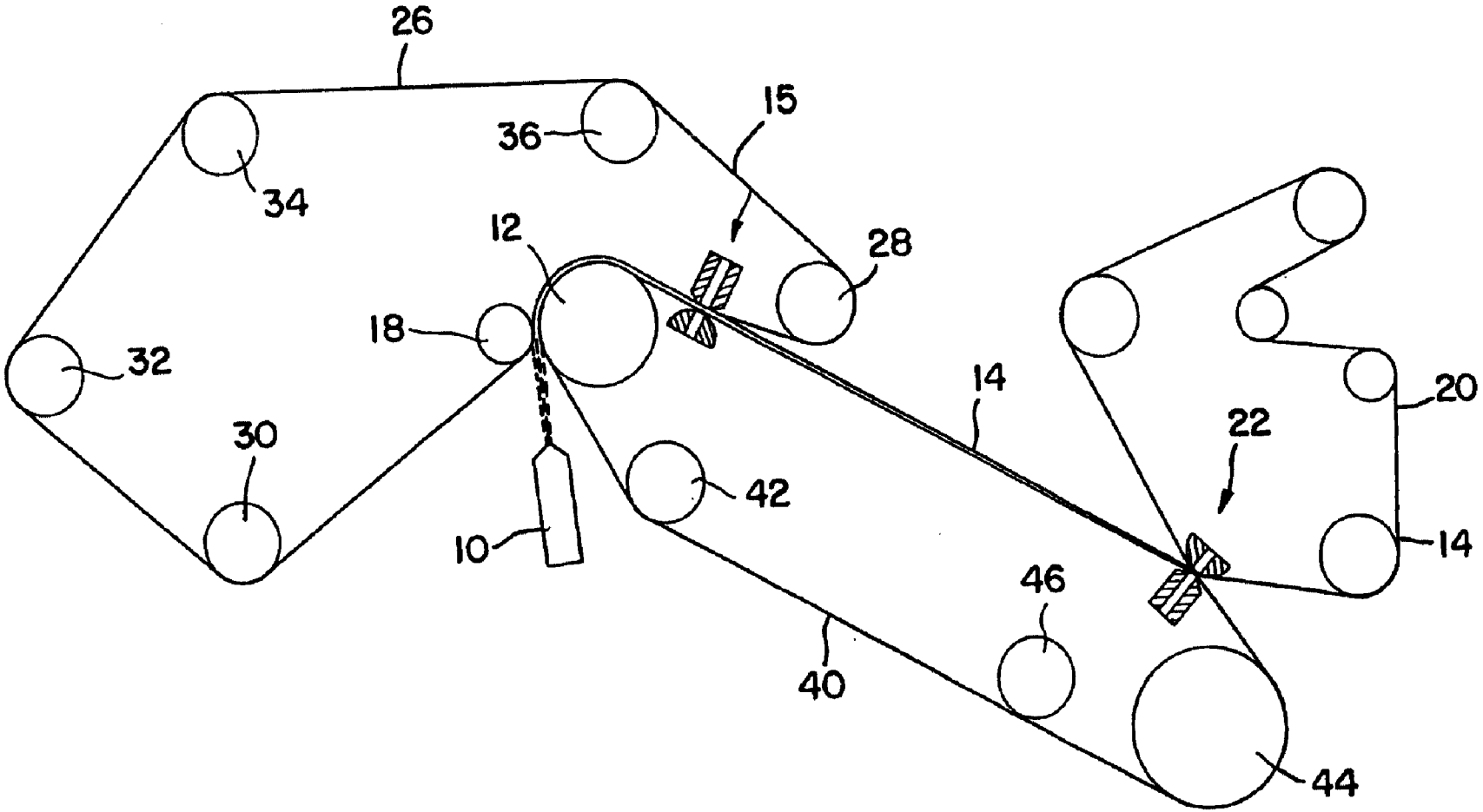
FIG. 1 is a schematic diagram of one embodiment of a wet paper making system made in accordance with the present invention.

Repeated use of reference characters in the present specification and drawings is intended to represent same or analogous features or elements of the present invention.

DETAILED DESCRIPTION OF PREFERRED EMBODIMENTS

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations and their equivalents.

The present invention is generally directed to paper webs, such as facial tissues, bath tissues and paper towels, that have an aesthetic, patterned appearance and that can be designed with improved stretch properties and tear resistance properties. More particularly, paper webs made according to the present invention have higher basis weight areas and lower basis weight areas. As used herein, the basis weight of a web refers to the mass of material per unit area. For example, basis weight can be measured in grams per square meter, ounces per square yard, or in pounds per ream. The differential basis weights can be contained within the paper web of the present invention according to any suitable pattern.

The ability to produce paper webs having a differential basis weight offers several benefits and advantages. For instance, the lower and higher basis weight areas can be used to form a decorative pattern into the paper web similar to a watermarking process. The decorative pattern can be visually recognizable and aesthetically pleasing. The decorative pattern can include straight lines, curved lines, flowers, butterflies, leaves, animals, toys, monograms, words, symbols, and the like. The pattern can be made up of separate discrete shapes or of reticular shapes.

Besides providing various aesthetic benefits, it is believed that the paper web of the present invention can also offer improved physical properties. For instance, it is believed that the basis weight differential can provide mechanical strength or stability in the direction of the higher basis weight areas and relatively lower stability or strength in the lower basis weight areas. Thus, it is believed that a given pattern can be used to adjust and control the strength and stability of the web in the machine direction or the cross machine direction. The lower basis weight areas can also make a web less stiff and more flexible, depending on the design.

It is believed that the lower basis weight areas in combination with the higher basis weight areas will create a web having physical properties similar to a laminated sheet, such as the combination of a base web and scrim. In this regard, depending upon the pattern created in the web, it is believed that the web can have increased cross directional strength and improved resistance to tear.

One process for producing a paper web made in accordance with the present invention will now be discussed in detail with reference to FIGS. 1, 2, and 8. In one embodiment, the present invention is directed to producing tissue products, such as bath tissues and facial tissues. Tissue products typically contain small fibers at a low consistency. FIG. 1 generally illustrates a roll former system traditionally used to produce such products. Specifically, the system illustrated in FIG. 1 is generally referred to in the art as a twin-wire system.

As shown, the papermaking system includes a headbox 10 configured to receive a dilute aqueous suspension of papermaking fibers. Headbox 10 is configured to inject the aqueous suspension of fibers in between a first forming fabric 26 and a second forming fabric 40. As illustrated, first forming fabric 26 and second forming fabric 40 comprise endless traveling conveyors.

Forming fabric 26 is supported and driven by a plurality of rolls 28, 30, 32, 34, and 36. Forming fabric 40, on the other hand, is supported and driven by rolls 42, 44, and 46. The speed at which fabric 26 is driven in relation to fabric 40 can depend upon the particular application. For instance, the speed at which fabric 40 is driven can be approximately the same speed at which fabric 26 is driven. Alternatively, however, fabric 40 can be driven at a slower speed or at a faster speed in relation to fabric 26 for increasing the bulk or otherwise changing the properties of a nonwoven web.

Forming fabrics 26 and 40 can be made from any suitable porous material, such as metal wires or polymeric filaments. Suitable fabrics can include, for example, Albany 84M and 94M available from Albany International of Albany, N.Y.; Asten 856, 866, 892, 959, 937 and Asten Synweve Design 274, available from Asten Forming Fabrics, Inc. of Appleton, Wis. The fabric can be a woven fabric as taught in U.S. Pat. No. 4,529,480 to Trokhan. Forming fabrics or felts comprising nonwoven base layers may also be useful, including those of Scapa Corporation made with extruded polyurethane foam such as the Spectra Series. Relatively smooth forming fabrics can be used, as well as textured fabrics suitable for imparting texture to the web.

Other suitable fabrics may include Asten 934 and 939, or Lindsay 952-S05 and 2164 fabric from Appleton Mills, Wis. Additionally, three-dimensional fabrics comprising deformable nonwoven upper layers may be suitable.

As shown in FIG. 1, once the fiber suspension is injected between forming fabric 26 and forming fabric 40, the fabrics contact and wrap around a forming roll 12. Forming Fabric 26 is placed adjacent to forming fabric 40 by a breast roll 18. Forming roll 12 is typically a drainage roll allowing water to drain out of the fiber suspension. In one embodiment, forming roll 12 can be a vacuum roll for further facilitating drainage.

A drainage roll is defined as a roll which is designed to assist in water removal and drainage. One method of assisting in water removal and drainage which has been found to be successful in a drainage roll is the presence of some sort of passages or channels for fluid to pass through. For example, in FIG. 2 a forming roll is illustrated having perforations which allow drainage of liquid.

In an alternative embodiment of the present invention, breast roll 18 can also be a drainage roll. That is, breast roll 18 can be capable of assisting in water removal and liquid drainage. In order to allow drainage, breast roll 18 can define some form of drainage channels, such as, for example, grooves or perforations. One possible embodiment of a breast roll 18 which is also a drainage roll is illustrated in FIG. 8.

After forming roll 12, forming fabric 26 diverges from forming fabric 40. As the fabrics diverge, a non-woven web 14 formed by the process becomes transferred solely to forming fabric 40. If desired, a transfer shoe 15 can be positioned in the system for facilitating transfer of the paper web 14 onto the forming fabric 40. The transfer shoe 15 can include a vacuum device and/or an air knife.

After formation, the paper web 14 can be transferred to various other fabrics, such as transfer fabric 20 using a second transfer shoe 22. Depending on the product being formed, paper web 14 can be fed to any suitable finishing and/or converting process. For example, the paper making process can utilize creping, embossing, wet-pressing, through-air drying, through-air dry creping, uncreped through-air drying, double creping, winding, finishing as well as other similar steps. For example, techniques, such as disclosed in U.S. Pat. Nos. 4,300,981; 5,048,589; 5,399,412; 5,494,544; and 5,785,813, which are all incorporated herein by reference to the extent they are not contradictory herewith, can be utilized.

As described above, the present invention is generally directed to forming paper webs having a distinctive pattern of lower basis weight areas and higher basis weight areas. In accordance with the present invention, in order to form the regions of higher and lower basis weight, the forming surface upon which the aqueous suspension of fibers is deposited includes a pattern of higher permeability areas and lower permeability areas. More specifically, the forming surface is either blocked off or lowered in permeability according to a particular pattern where the aqueous suspension is deposited. In this manner, a greater density of fibers is drawn to the areas of higher permeability in the forming surface where greater amounts of drainage occur. Conversely, lesser amounts of fibers are drawn to the areas of lower permeability where less drainage through the forming fabric occurs. Thus, a pattern of fiber distribution gradients can be established in the nascent web.

Forming fabric permeability may be determined through any one of several standard permeability tests. One such permeability test is the Frazier Permeability test. This test provides a measure of the permeability of a fabric or web to air. This test is performed according to Federal Test Standard 191A, Method 5450 dated Jul. 20, 1978 and is reported as an average of 3 sample readings. Frazier Permeability measures the air flow rate through a web as standard cubic feet of air flow per square foot of material per minute with an air pressure differential of 0.5 inches (12.7 mm) of water under standard conditions.

The fabrics of the present invention can have any suitable Frazier air permeability. For example, forming fabrics of the present invention can have a permeability of from about 250 standard cubic feet per square foot per minute (about 76 standard cubic meters per square meter per minute) to about 600 standard cubic feet per square foot per minute (about 180 standard cubic meters per square meter per minute) in the higher permeability areas, and can have a permeability of from about 100 standard cubic feet per square foot per minute (about 30 standard cubic meters per square meter per minute) to about 400 standard cubic feet per square foot per minute (about 120 standard cubic meters per square meter per minute) in the lower permeability areas. In certain embodiments of the present invention, however, liquid flow can be completely blocked at the lower permeability areas.

The manner in which the lower permeability areas are created in the forming surface can vary depending upon the particular application and the desired result. For example, in one embodiment, the permeability of the forming surface 40 or 26 is varied by varying the drainage properties and the permeability of one or more drainage rolls which contact the forming surface in the process. For example, the permeability of forming surface 40 can be varied by varying the drainage properties and permeability of the forming roll 12 as shown in FIG. 1. Alternatively, the permeability of the forming surface 26 can be varied by varying the drainage properties and the permeability of the breast roll 18. In yet another possible embodiment, the permeability of both of the forming surfaces 40 and 26 can be varied by varying the permeability and drainage properties of both the forming roll 12 and the breast roll 18.

Figure 2:
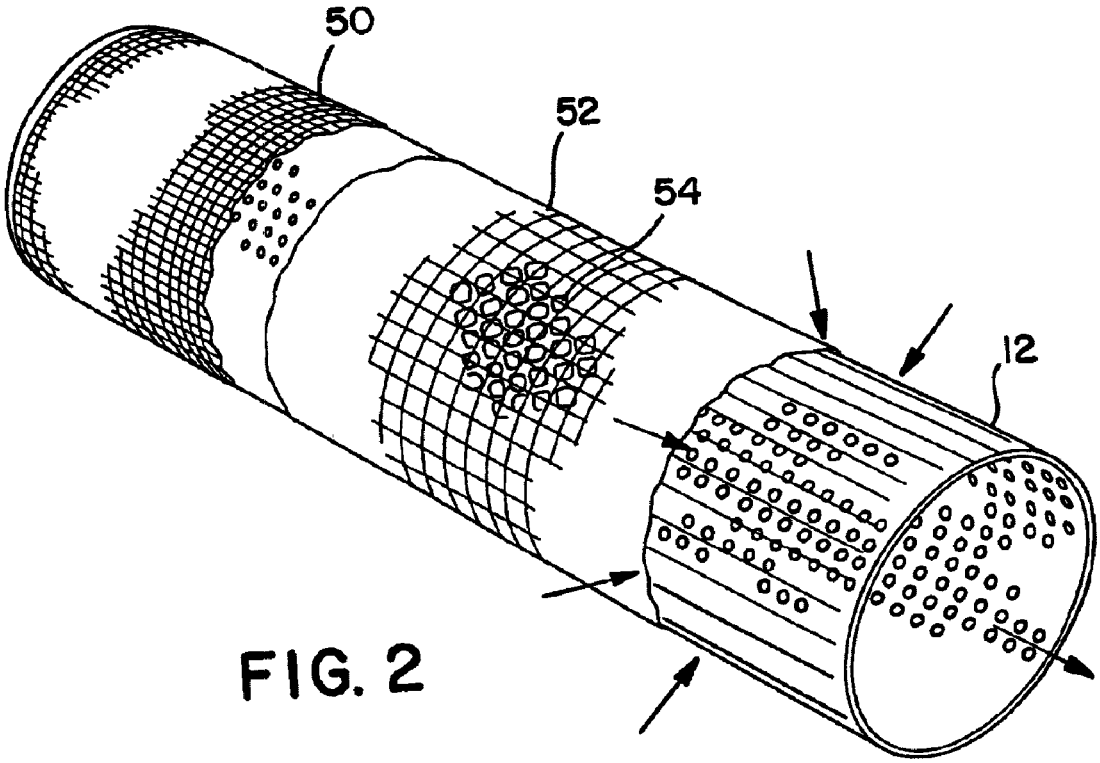
FIG. 2 is a perspective view of one embodiment of a forming roll that may be used in accordance with the present invention illustrating two different types of forming roll sleeves.

Referring to FIG. 2, the forming roll 12 is shown in greater detail. As is conventional, the forming roll 12 includes a perforated cylinder. The perforations allow for drainage through the cylinder as shown by the arrows. As described above, a suction force can also be created within the cylinder to further promote drainage.

In order to control the rate of drainage, a drainage roll, such as for example, forming roll 12, can be covered by a porous sleeve. The porous sleeve can be a wire as shown at 50 or can be made from polymeric filaments as shown at 52. Forming roll sleeve 50 or 52 generally has properties similar to forming fabric 40 or forming fabric 26.

In accordance with the present invention, in order to vary the permeability of the forming roll 12, the forming roll sleeve includes lower permeability areas which reduce or prevent drainage through the forming roll. For example, as shown in FIG. 2, a pattern of lower permeability areas 54 can be applied to the forming roll sleeve 52.

The process of the present invention can be used with either the forming roll sleeve 52 made from polymeric fibers or the forming roll sleeve 50 made from a wire mesh. In general, forming roll sleeves made from polymeric fibers typically are placed over the perforated cylinder of the forming roll and then shrunk into place by exposing the sleeve to water and heat. Wire mesh sleeves, on the other hand, are typically tightened around the forming roll and soldered into place. The forming roll sleeves rotate with the perforated cylinder as the paper web is being formed.

In addition to drainage at the forming roll 12, breast roll 18 can also be designed as a drainage roll. In order to promote drainage at the breast roll 18, breast roll 18 can be, for example, a grooved, perforated or channeled breast roll.

Figure 8:
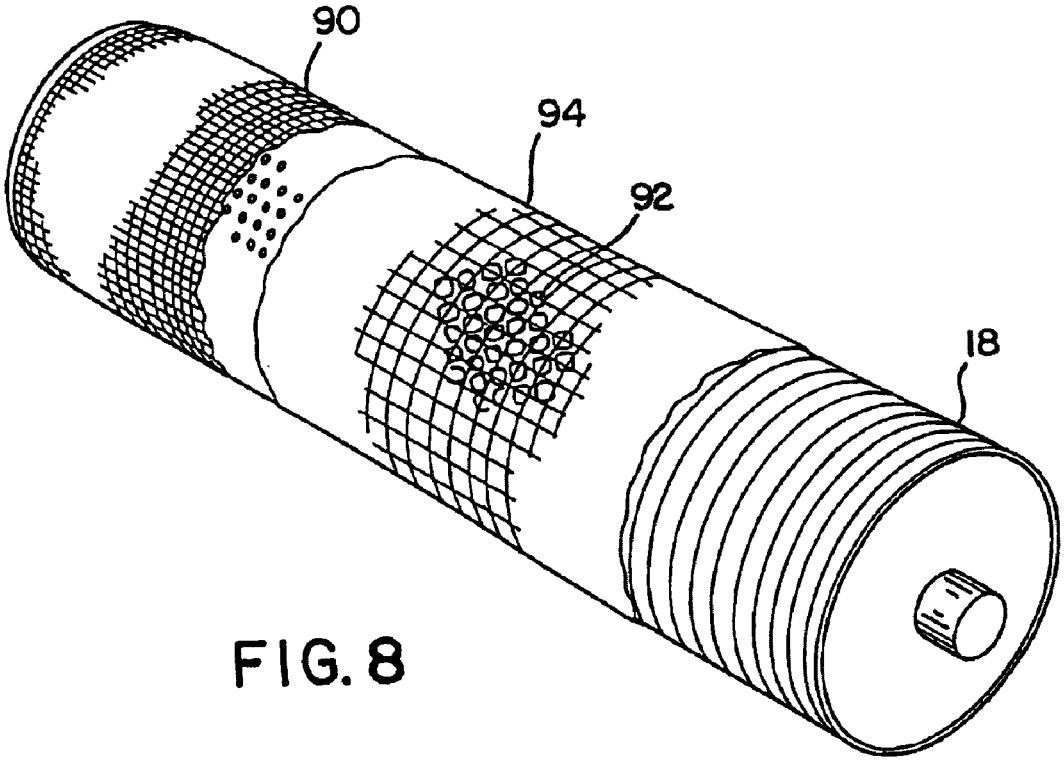
FIG. 8 is a perspective view of one embodiment of a grooved breast roll that may be used in accordance with the present invention illustrating two different types of breast roll sleeves.

Referring to FIG. 8, one embodiment of a grooved breast roll is shown in greater detail. When a grooved breast roll is utilized, the grooves may be in any suitable formation. For example, the grooves may be circumferential, as shown, or alternatively may be longitudinal, at an angle to the axis of the roll, or some combination of grooves. Grooved breast rolls have been shown to contribute significantly to the drainage of the head box jet, as disclosed in EP0532741 to Krall, which is herein incorporated by reference to the extent it is not contradictory herewith.

In one embodiment of the present invention, the breast roll 18, can be covered by a porous sleeve similar to the forming roll sleeves previously discussed. As shown in FIG. 8, the breast roll sleeve can be a wire sleeve as shown at 90 or alternatively can be formed from polymeric filaments as shown at 92.

In an embodiment wherein the breast roll 18 is covered by a porous sleeve, the breast roll sleeve 90 or 92, can have areas of lower permeability 94 applied to the sleeve, similar to the forming roll sleeve as shown in FIG. 2. In general, a breast roll sleeve and a forming roll sleeve can both be referred to as a drainage roll sleeve. A drainage roll sleeve can generally cover a breast roll, a forming roll, or any other type of drainage roll.

The process of the present invention can include embodiments wherein either the forming surface 40 in contact with the forming roll 12 or the forming surface 26 in contact with the breast roll 18 can include a pattern of higher permeability areas and lower permeability areas. Alternatively, both of the forming surfaces 40 and 26 can include a pattern of higher and lower permeability areas.

Figure 3:
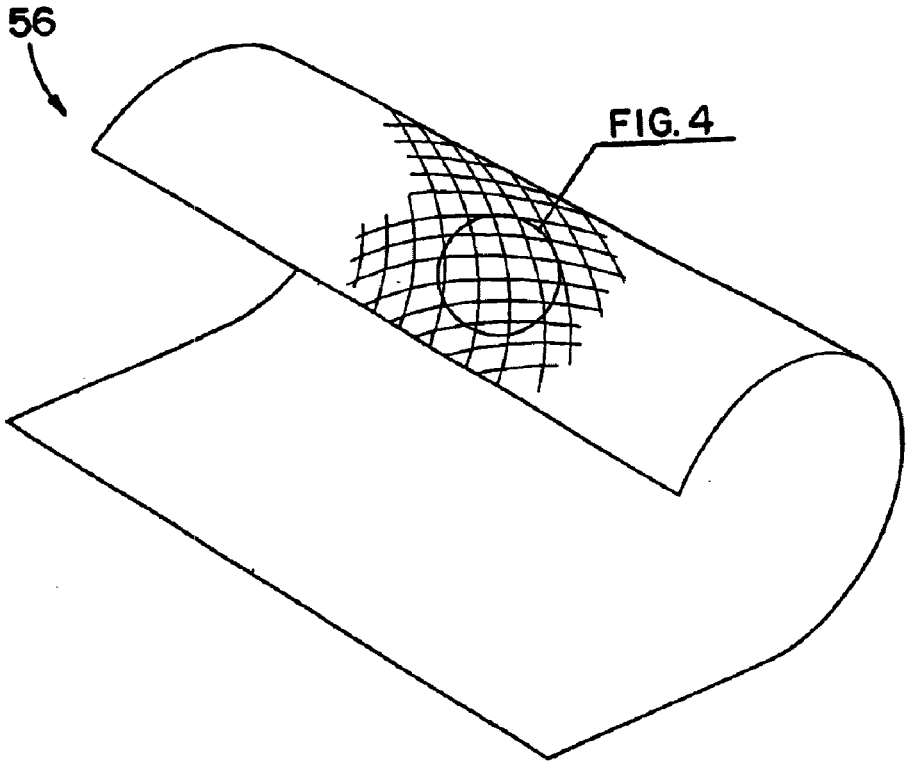
FIG. 3 is a perspective view of one embodiment of a drainage roll sleeve to be used in accordance with the present invention

Referring to FIG. 3, a representative drainage roll sleeve generally 56 made in accordance with the present invention is shown that can include a lower permeability pattern. As represented in FIG. 3, drainage roll sleeve 56 can be made from wire, polymeric filaments, or any other suitable material.

Differential basis weight paper webs made according to the present invention can be made having an almost limitless variety of different patterns with respect to where the higher basis weight areas and the lower basis weight areas are located. For instance, the higher basis weight areas and lower basis weight areas can be formed into a repeating pattern that appears random or can be formed into a discernable geometrical pattern. For example, the higher basis weight areas and lower basis weight areas can form alternating columns, alternating rows, or can form a checkered pattern.

In one embodiment, the lower basis weight areas will appear as individual shapes. The individual shapes can be connected or can be separated and surrounded by the higher basis weight areas. In general, the individual shapes have a greatest dimension (i.e. the diameter of a circle, the diagonal of a square or rectangle, etc.) of greater than 1 mm, particularly greater than 2 mm, and in one embodiment, greater than 3 mm.

Figure 4A:
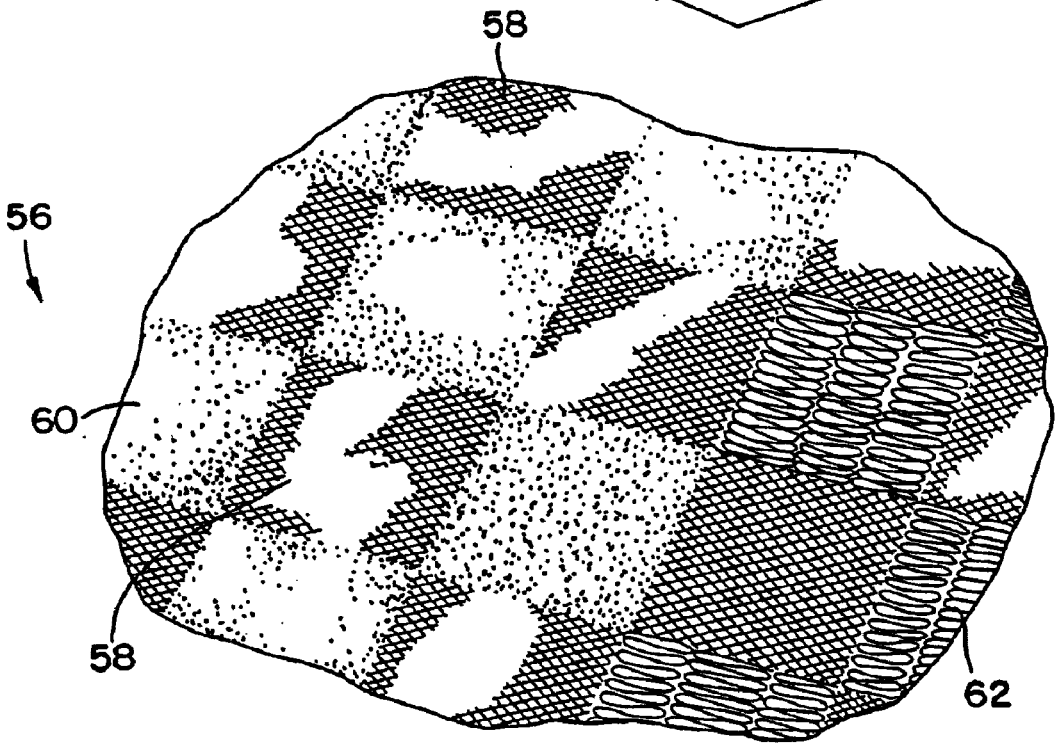
FIGS. 4A, 4B, and 4C are perspective views of various embodiments of drainage roll sleeves made in accordance with the present invention.
Figure 4B:
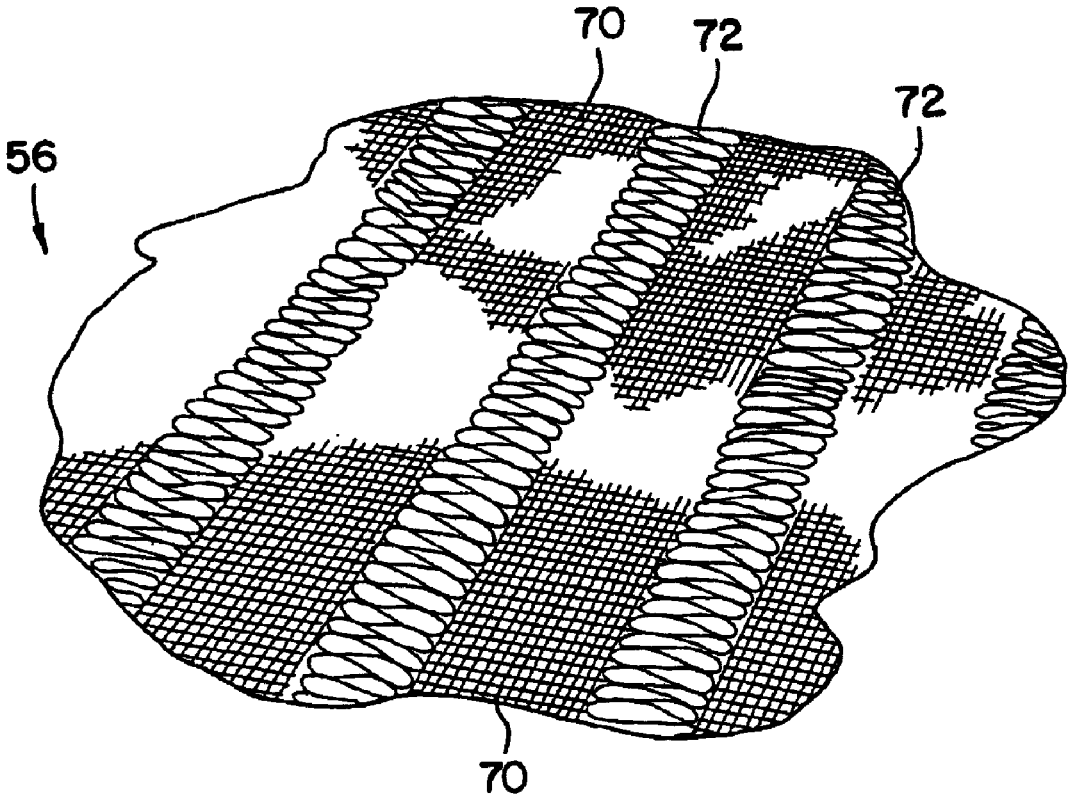
Figure 4C:
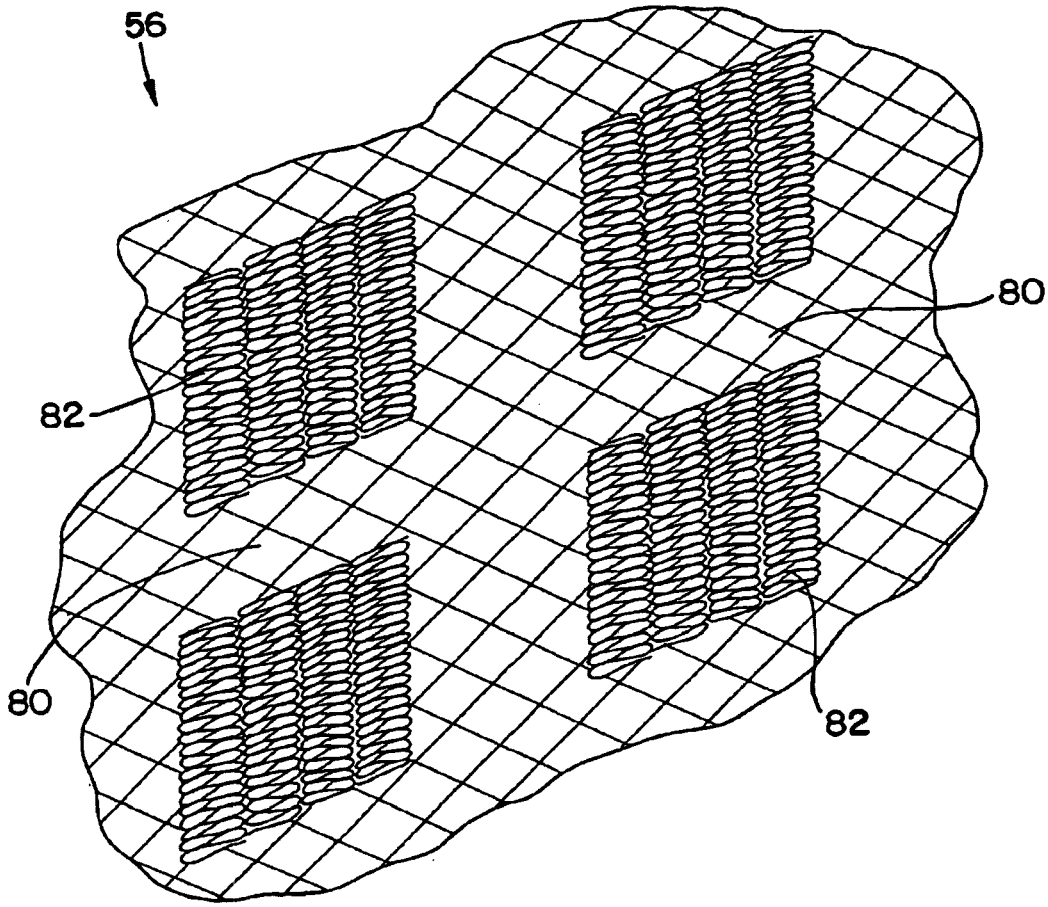

Examples of patterns that can be formed into the drainage roll sleeve 56 shown in FIG. 3 are illustrated in FIGS. 4A, 4B and 4C. As shown in FIG. 4A, the drainage roll sleeve 56 includes higher permeability areas 58 and lower permeability areas 60 and 62. In this embodiment, a checkered pattern is formed by lower permeability areas 60 and 62 and higher permeability areas 58. Further, lower permeability areas 60 include a different design and permeability than lower permeability areas 62.

In this regard, it should be understood that the lower permeability areas 60 and 62 can be made according to various different methods. For instance, a coating can be placed on the drainage roll sleeve 56 where the lower permeability areas 60 and 62 are desired. The coating can be formed from, for instance, glue, caulk, paint, an epoxy, or any other suitable material.

In another possible embodiment, a photosensitive resin can be applied to the drainage roll sleeve by, for example, dip coating. The resin can then be exposed to light according to a particular pattern which causes the photosensitive material to react and polymerize. A solvent can then be used to wash off the areas not exposed to the light leaving behind the desired pattern. Alternatively, exposure to light may cause the photosensitive resin to react and become dissolvable in a solvent. In this embodiment, when the sleeve 56 is contacted with a solvent, the areas of the resin that have been exposed to light energy wash off, once again leaving behind the desired pattern.

Besides a photo-sensitive material, other materials can be applied and selectively removed from the drainage roll sleeve in order to form a pattern of higher and lower permeability areas. For example, the entire drainage roll sleeve 56 may be coated with a low permeable material, such as rubber. After the sleeve has been coated, a portion of the coating material can then be removed. In such an embodiment, the drainage roll sleeve 56 can have lower permeability areas 60 and 62 in those areas in which the coating remains, and the higher permeability areas 58 in those areas where the coating has been selectively removed.

In another embodiment, the pattern may be screen printed onto the drainage roll sleeve 56. Such a process could be, for example, a silk screening process. A screen printing process may be found to be particularly suitable for creating the higher and lower areas of permeability on a drainage roll sleeve when the base fabric has a low porosity. For instance, one example of a low porosity fabric which may be used in a screen printing process is a multi-layered fabric.

When screen printing, various different types of coating materials can be applied to the drainage roll sleeve. For example, in one embodiment a coating material can be utilized that has a high viscosity, such as an epoxy boat paint, or a rubbery, latex paint. In such an embodiment, the high viscosity coating material may be found to absorb well onto a low porosity base fabric, for example a multi-layer base fabric.

When it is desired to create lower permeability areas 60 and 62 with a process involving one or more coating materials, choice of coating materials should be made with care. When choosing the coating material for the drainage roll sleeve, consideration for both the drainage roll sleeve material and the method to be used in applying the drainage roll sleeve to the drainage roll can be taken into account. For example, in one possible embodiment, the drainage roll sleeve can be made from polymeric fibers which may then be shrunk into place on the drainage roll by exposing the sleeve to water and heat. In this particular embodiment, it may be preferable to choose a coating material that can withstand the heat shrinkage process without damage or distortion of the coating material and thus avoid damage to the lower permeability areas 60 and 62.

Besides applying a coating to the drainage roll sleeve, other methods can be used to create the lower permeability areas 60 and 62. For example, an embroidered pattern or a jacquard pattern can be woven into the drainage roll sleeve 56. The choice of material used to form the pattern should be carefully made, however, in order to ensure the pattern is not distorted when the drainage roll sleeve is applied to the drainage roll. For example, if the drainage roll sleeve is applied to the drainage roll by a shrinkage process, the shrinkage properties of the base sheet should be taken into account in comparison to the shrinkage properties of the pattern material in order to avoid distortion of the pattern on the drainage roll sleeve. For example, if the pattern material and the base sheet material have different shrinkage properties, the pattern would need to be adjusted accordingly so that the final drainage roll sleeve 56, after application to the drainage roll, is of the desired shape and characteristics.

When a jacquard pattern is utilized, it may be woven into the fabric at the time of fabric formation by use of one or more jacquard heads mounted using a second warp beam as disclosed in U.S. Pat. No. 5,429,686, which is herein incorporated by reference to the extent it is not contradictory herewith. This method allows a flow retarding layer and a base layer to be woven directly together into the fabric.

One possible embodiment of such a fabric is a multilayer fabric which may be formed having a coarse fabric layer on the surface of the drainage roll sleeve which can contact the forming surface. The coarse fabric layer can be configured to have open and closed areas created by the design of the weave. The closed, lower permeability areas can be those areas of the weave having the higher density weave pattern. These areas of a higher density weave pattern provide physical flow restrictions to the liquid coming off of the nascent web and thus have a lower permeability than areas of the weave having a lower density weave pattern.

In a further embodiment, the drainage roll sleeve 56 can be made up of different fabrics having different mesh characteristics that are attached together according to the desired pattern.

In another possible embodiment, the drainage roll sleeve 56 can have physical barriers applied to the fabric in a pattern. The presence of the barriers can alter the permeability of the sleeve in those areas. For example, pre-stamped metallic shapes can be applied to the drainage roll sleeve 56 in a pattern. The metallic shapes can be applied to the drainage roll sleeve 56 either before or after the drainage roll sleeve 56 is applied to the drainage roll. The metallic shapes can be made from a solid material or alternatively, can be perforated. The manner of applying such pre-stamped forms depends upon the material of the sleeve itself. If, for example, the sleeve is formed of a metallic mesh, metallic shapes may be wired or soldered onto the surface of the sleeve. If, instead, the sleeve is formed of a polymeric material, some other suitable method of attachment could be employed, such as, for example adhesives or thermal bonding.

In still another embodiment, the pattern can be formed into the drainage roll sleeve 56 using an electrotyping process. In an electrotyping process, a mold made from wax or another suitable material is created. The mold is then used to form a desired pattern or individual distinct shapes through an electroplating process. The pattern or shapes can be made from copper or any other suitable metal. The pattern or figures are then attached to the drainage roll sleeve 56 by some suitable method. For example, if the drainage roll sleeve 56 is a wire mesh material, the pattern or figure may be soldered onto the drainage roll sleeve 56.

Whatever method is chosen for creating the areas of higher and lower permeability, the hydroscopics of the various materials should be taken into account in producing a drainage roll sleeve 56 for use in a paper making process. For example, if a coating method is used to form lower permeability areas 60 and 62, it may be beneficial to the paper making process to consider the hydroscopic characteristics of the coating material in order to maintain control of the permeability of the area covered by the coating material. This may also be factor to be considered when the areas of lower permeability are created by other methods and means, such as a weaving or barrier method.

Yet another possible embodiment of a drainage roll sleeve having higher and lower areas of permeability are highly textured through air drying fabrics such as those disclosed in U.S. Pat. No. 5,429,686. These fabrics contain a high z-directional profile. The high areas formed of warp bundles would be expected to have a different drainage rate than the valleys of the fabric. Thus, the fabric weave itself may provide for areas of different basis weight in the product web due to the surface characteristics of the forming fabric on the drainage roll sleeve 56.

It should be understood that any of the various methods described above can be combined in order to produce the different areas of lower permeability on the drainage roll fabric.

Referring to FIG. 4B, an alternative embodiment of a pattern formed into the drainage roll sleeve 56 is shown. In this embodiment, the drainage roll sleeve 56 includes higher permeability areas 70 and lower permeability areas 72. As shown, higher permeability areas 70 and lower permeability areas 72 form alternating columns. Depending on the particular application, the columns can be formed in the machine direction, can be formed perpendicular to the machine direction i.e., in the cross-machine direction, or can be formed in a diagonal direction. As described above, the lower permeability areas 72 will create lower basis weight areas on a paper web formed in conjunction with the drainage roll sleeve 56.

Referring to FIG. 4C, another embodiment of a patterned drainage roll sleeve is illustrated. As shown in this embodiment, the sleeve 56 includes higher permeability areas 80 and lower permeability areas 82. The lower permeability areas 82 appear in the form of discrete shapes that are arranged according to a geometric pattern. In this embodiment, the shapes are diamonds but it should be understood that various other shapes can also be formed into the sleeve 56.

Figure 6:
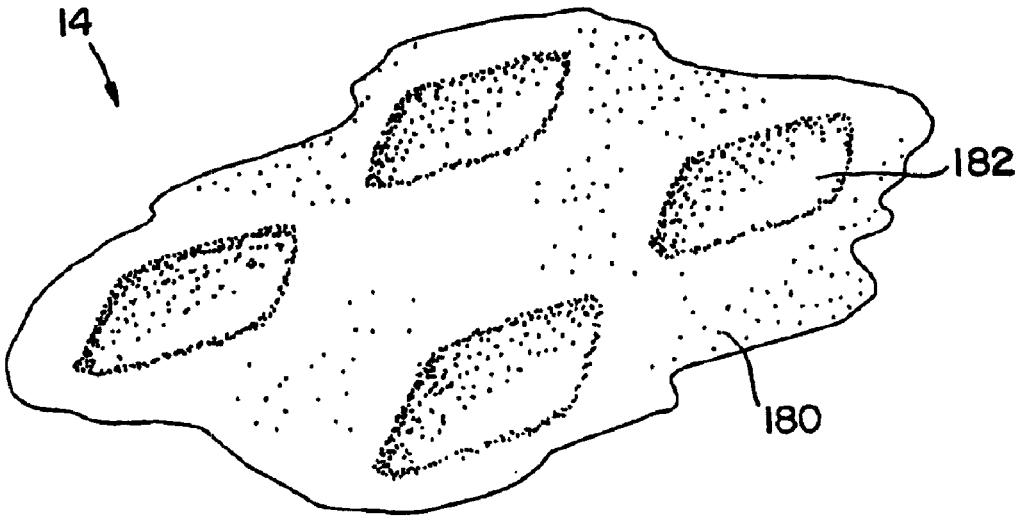
FIG. 6 is a perspective view of one embodiment of a paper web made in accordance with the present invention.

Referring to FIG. 6, a paper web 14 is shown that is intended to represent a web that would be formed in conjunction with the patterned drainage roll sleeve 56 illustrated in FIG. 4C. As shown, the paper web 14 includes lower basis weight areas 182 surrounded by higher basis weight areas 180.

When a paper web 14 as shown in FIG. 6 is formed using the drainage roll sleeve 56 illustrated in FIG. 4C, higher basis weight areas 180 can form channels in between the discrete shapes of lower basis weight areas 182. In this manner, the higher basis weight areas 180 can form strength lines in the web 14. The higher basis weight areas 180 can also provide better durability and better tear resistance.

Besides the above described patterns, various other aesthetic patterns can be formed into the drainage roll sleeve 84. Such patterns can include logos, designs, symbols, words, phases, and the like. For instance, referring to FIG. 5, a further embodiment of a drainage roll sleeve 84 is shown in accordance with the present invention. In this embodiment, the drainage roll sleeve 84 includes higher permeability areas 86 and lower permeability areas 88. Lower permeability areas 88 are in the shape of flowers that can then be transferred to a paper web formed on the drainage roll sleeve 84. In this manner, a highly distinctive paper product can be formed having an aesthetically pleasing appearance.

Figure 5:
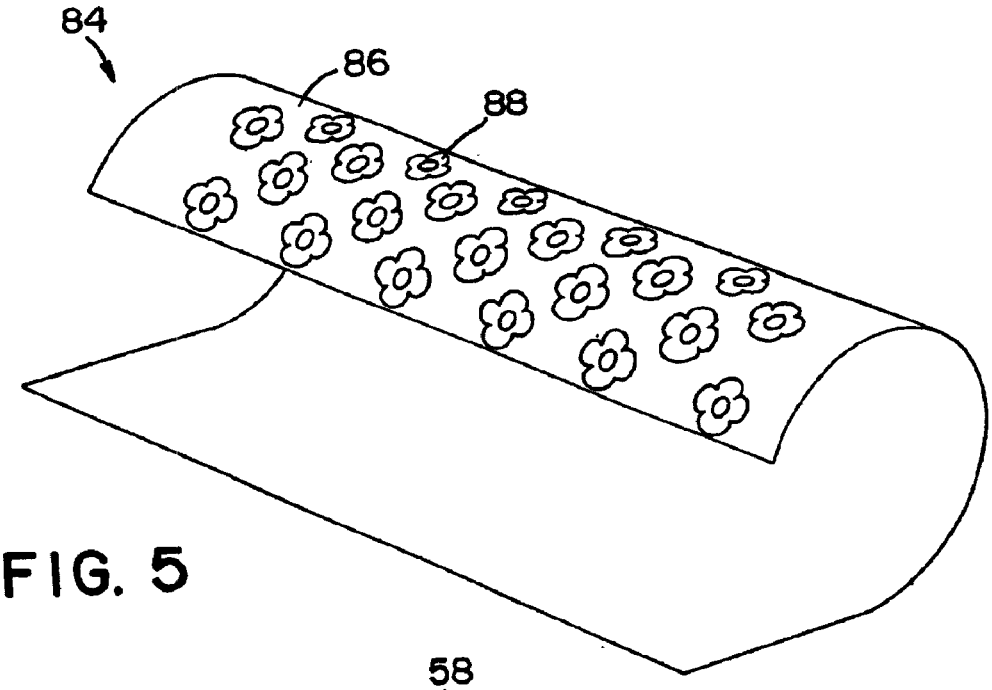
FIG. 5 is a further alternative embodiment of a drainage roll sleeve made in accordance with the present invention.
Figure 7:
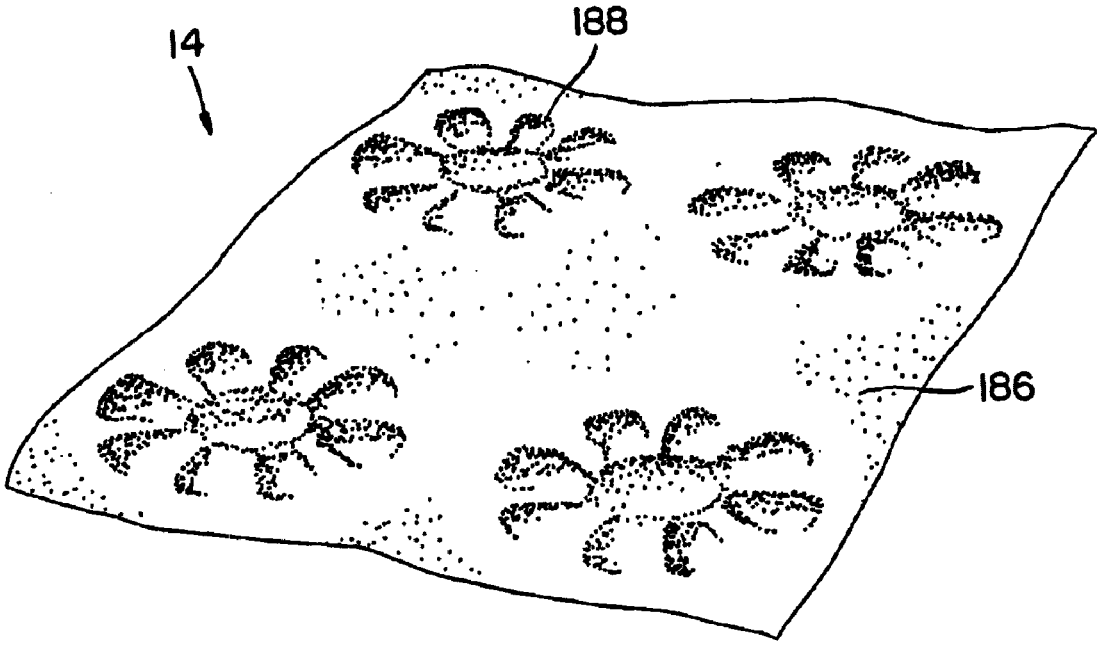
FIG. 7 is a perspective view of another embodiment of a paper web made in accordance with the present invention.

For example, as shown in FIG. 7, a paper web 14 is illustrated that is representative of a paper web that may be formed using the drainage roll sleeve 84 depicted in FIG. 5. The paper web 14 includes lower basis weight areas 188 in the shape of flowers surrounded by higher basis weight areas 186.

The design appears into the web as a watermark. Of particular advantage, the design is formed into the web without any additional processing steps in forming the paper product itself. For example, in the past, it was conventional to emboss patterns into webs after they were formed which created an additional processing step.

The ratio of higher basis weight areas to lower basis weight areas in the formed paper web can vary depending upon the particular application and the result desired. For most applications, however, the higher basis weight areas should comprise greater than 5% and particularly from about 25% to about 75% of the total surface area of the web. It should be understood, however, that the ratio of lower basis weight areas to higher basis weight areas can vary dramatically depending upon a particular application and the desired result. For example, the process of the present invention can be used to produce webs having improved physical properties. On the other hand, the process of the present invention can be used simply to form an aesthetically appealing design without substantial regard to the properties of the web.

The variation in basis weight between the higher basis weight areas and the lower basis weight areas can also be varied as desired. The amount of difference between the higher basis weight areas and the lower basis weight areas will generally depend on the manner in which the permeability of the forming surface is varied and the type of drainage that is used during the process. Specifically, it has been discovered that the width of the reduced permeable areas has a relatively large impact on the resulting product.

For example, in one extreme, the drainage roll sleeve can have fully open permeability areas and fully closed permeability areas creating the greatest amount of differential in basis weight. Alternatively, the drainage roll sleeve can have a permeability profile in which the permeability of the forming surface gradually decreases from higher permeability to lower permeability areas. In this embodiment, the basis weight of a web formed on the surface will gradually decrease from the higher basis weight areas to the lower basis weight areas in a predetermined, controlled manner.

The extent the basis weight varies within the paper web will also depend upon the drainage characteristics of the paper making system. For instance, referring to FIG. 1, fluid drainage can occur not only through forming fabric 40 via forming roll 12, but also through first forming fabric 26. Further, drainage can also occur through breast roll 18 as described above.

When drainage occurs through two opposing forming fabrics, the system is generally known as a two-sided drainage system. The amount of variation in basis weight will generally depend upon the relative amount of drainage through both sides. For example, the system can be configured such that the drainage through the forming roll can range anywhere from 20% to about 90% by weight of the total amount of liquids drained from the aqueous suspension. For most applications, however, the amount of drainage through the forming roll should be between about 40% to about 60% by weight of the total amount of liquid drained from the aqueous suspension.

The manner in which liquid drainage is controlled through forming fabric 40 and first forming fabric 26 can vary. For example, drainage through the forming roll 12 can be increased or decreased by increasing or decreasing a suction force located within the roll. Drainage through forming fabric 40 and forming fabric 26 can also be controlled by varying the relative permeabilities of both fabrics.

Of particular advantage, in a two-sided drainage system, the extent to which the pattern is formed into the paper web can be controlled. For instance, in a two-sided drainage system, the paper web can be formed having a laminate-like structure. For instance, if forming roll 12 has a forming roll sleeve with a pattern of lower permeability areas applied to it, the side of the web formed contacting forming fabric 40 can have higher and lower basis weight areas. If, in addition, breast roll 18 is not designed as a drainage roll having a pattern of higher and lower permeability, the side of the web contacting forming fabric 26 may have a substantially homogenous fiber structure.

Thus, a web can be formed having two sides with different fiber distribution characteristics. Alternatively, however, most of the drainage can occur through the forming fabric 40 such that substantially the entire thickness of the web has a basis weight gradient.

In still another embodiment, breast roll 18 can be a drainage roll having a drainage roll sleeve providing a pattern of higher and lower permeability areas. In this embodiment, the breast roll sleeve can create higher and lower basis weight areas in the web, while forming roll 12 can provide homogenous drainage properties through forming surface 40.

In yet another alternative embodiment, both forming roll 12 can be covered with a forming roll sleeve having lower permeability areas and breast roll 18 can be a drainage roll covered with a breast roll sleeve having lower permeability areas. In this particular embodiment, both sides of the web can have a basis weight gradient. For example, one side of the web contacting forming fabric 26 at the grooved breast roll can have a pattern of fiber distribution gradients consistent with the pattern of lower permeability areas on the breast roll sleeve. The other side of the web contacting forming fabric 40 can have a different pattern of fiber distribution gradients consistent with the pattern of lower permeability areas on the forming roll sleeve. These gradients can be similar to each other, if the forming roll sleeve and the breast roll sleeve have substantially the same patterns of higher and lower permeability areas, or they can be different. The two patterns formed on either side of the web can overlap each other. The overlap may be random, or alternatively, may be controlled.

In general, the ratio between the basis weight of the higher basis weight areas and the basis weight of the lower basis weight areas can be at least about 1.1:1 and, particularly, from about 1.1:1 to about 5:1. More particularly, the higher basis weight areas can be from about 1.1 to about 3.3 times greater than the lower basis weight areas. These ranges can change, however, depending upon the particular application.

Paper webs made in accordance with the present invention can be made from any suitable paper making fibers. Such fibers can include fibers derived from wood, cotton, flax, hemp, bagasse, kenaf, and other natural materials. Small amounts of synthetic fibers can also be included in the aqueous slurry. For most applications, the aqueous slurry will contain softwood fibers, hardwood fibers, or a combination of hardwood and softwood fibers.

The papermaking slurry of the present invention can also include various chemicals and fillers as is known in the art. Such materials can include temporary and permanent wet strength resins; dry strength additives such as starches and catalytic charged polymers; reactive dye components; polymeric retention aides, including bio-component systems and systems involving silica clays and the like; mineral and organic fillers; opacifiers, including waxes and microspheres; softeners and debonders; and the like. Further, the fibers can be subjected to any number of mechanical, chemical and thermoprocessing steps, including mechanical refining, chemical cross linking, steamed explosion, mechanical dispersing or kneading, oxidation or sulfonation, exposure to elevated temperature, etc.

The types of paper products that can be made according to the present invention vary widely. For instance, the process of the present invention can be used to produce paper towels, industrial wipers, and is particularly well suited to producing facial tissue and bath tissue. The paper products formed can be single layer products or multi-ply products.

When producing tissue products, the paper products can have an overall basis weight of from about 6 lbs per ream to about 25 lbs per ream. Paper towels and industrial wipers, on the other hand generally have a overall basis weight of from about 20 lbs per ream to about 70 lbs per reams, particularly from about 20 lbs per ream to about 50 lbs per ream.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A process for producing a paper web comprising:

forming an aqueous suspension of fibers comprising pulp fibers;

directing said aqueous suspension between a first forming surface and a second forming surface, said first and second forming surfaces being configured to allow fluids to drain from said aqueous suspension, said first forming surface located on a first drainage roll, said first drainage roll being surrounded by a first drainage roll sleeve, said first drainage roll sleeve being located between said first drainage roll and said first forming surface, said first drainage roll sleeve having a first predetermined pattern of lower permeability sections; and forming a paper web between said first and second forming surfaces from said aqueous suspension of fibers, said paper web defining first areas having a first basis weight and second areas having a second basis weight, said first basis weight being greater than said second basis weight, said second areas forming on said first forming surface where said lower permeability sections are located on said drainage roll sleeve, said first and second areas defining a first pattern of fiber distribution gradients.

2. A process as defined in claim 1, wherein said first drainage roll is a breast roll, said breast roll defining drainage channels.

3. A process as defined in claim 1, wherein said first drainage roll is a forming roll.

4. A process as defined in claim 1, wherein said second forming surface is positioned on a second drainage roll, said second drainage roll being surrounded by a second drainage roll sleeve comprising a second predetermined pattern of lower permeability areas, said second drainage roll sleeve being located between said second drainage roll and said second forming surface, said paper web defining a second pattern of fiber distribution gradients, said second pattern of fiber distribution gradients forming on said second forming surface according to said second predetermined pattern of lower permeability areas.

5. A process as defined in claim 4, wherein said first drainage roll is a forming roll and said second drainage roll is a breast roll.

6. A process as defined in claim 4, wherein said first pattern of fiber distribution gradients and said second pattern of fiber distribution gradients form visible patterns on said paper web.

7. A paper product comprising:

a paper web containing pulp fibers comprising a first side and a second side, said first side defining first areas having a first basis weight and second areas having a second basis weight, said first and second areas located on said first side according to a first predetermined pattern, said first basis weight being at least 1.1 times greater than said second basis weight, said first side having a first pattern of fiber distribution gradients according to said first predetermined pattern, said second side of said web having a fiber distribution that is substantially homegenous.

8. A paper product as defined in claim 7 wherein said second areas comprise individually discrete shapes surrounded by said first areas.

9. A paper product as defined in claim 8, wherein said individually discrete shapes have a greatest dimension of at least 1 mm.

10. A paper product as defined in claim 7, wherein said pattern of fiber distribution gradients is visible.

11. A paper product as defined in claim 7, wherein said first basis weight is from about 1.1 to about 3.3 times greater than said second basis weight.

12. A paper product as defined in claim 7, wherein said paper web has a basis weight of less than about 25 lbs per ream.

13. A paper product as defined in claim 7, wherein said paper web has a basis weight of from about 25 to about 70 lbs per ream.

14. A paper product as defined in claim 7, wherein said paper web consists essentially of pulp fibers.

15. A paper product as defined in claim 7, wherein said first areas form rows surrounding said second areas.

16. A paper product as defined in claim 7, wherein said paper product has lateral edges and wherein at least certain of said rows formed by said first areas are diagonal to said lateral edges.

17. A paper product as defined in claim 7, wherein said first areas comprise at least about 25% of the area of said paper web.

18. A paper product as defined in claim 7, wherein said paper web is a single layer.

19. A paper product as defined in claim 7, wherein said paper product comprises a tissue.

20. A paper product as defined in claim 7, wherein said paper product comprises a paper towel.

21. A paper product as defined in claim 7, wherein the pattern of second areas having a second basis weight located on the first side of the paper web substantially corresponds to a pattern of lower permeability sections on a drainage roll sleeve upon which the paper web is formed.

* * * * *